United States Patent [19]

Gordon

[11] Patent Number: 4,898,381

[45] Date of Patent: Feb. 6, 1990

[54] MULTI-EXERCISE SYSTEM

[76] Inventor: Joel D. Gordon, 3311 Woodvalley Dr., Baltimore, Md. 21208

[21] Appl. No.: 275,750

[22] Filed: Nov. 23, 1988

[51] Int. Cl.[4] ..... A63B 21/06

[52] U.S. Cl. ..... 272/117; 272/118; 272/134; 272/DIG. 4

[58] Field of Search ..... 272/117, 118, 123, 132, 272/134, 144, DIG. 4

[56] References Cited

U.S. PATENT DOCUMENTS

| | | | |
|---|---|---|---|
| 3,721,438 | 3/1973 | Kusmer | 272/132 X |
| 4,505,475 | 3/1985 | Olschansky et al. | 272/134 X |
| 4,603,855 | 8/1986 | Sebelle | 272/134 X |
| 4,634,127 | 1/1987 | Rockwell | 272/118 X |
| 4,721,301 | 1/1988 | Drake | 272/118 |
| 4,721,303 | 1/1988 | Fitzpatrick | 272/117 |

FOREIGN PATENT DOCUMENTS

| | | | |
|---|---|---|---|
| 2158362 | 11/1985 | United Kingdom | 272/118 |

*Primary Examiner*—Richard J. Apley
*Assistant Examiner*—Robert W. Bahr
*Attorney, Agent, or Firm*—Morton J. Rosenberg; David I. Klein

[57] ABSTRACT

A home gym system (100) is provided for performing weight lifting exercises with a load resistance (160, 164) coupled to a cable (132). The home gym system (100) includes a main frame (110) to which is pivotedly coupled at least one extension frame (120). A guide arm assembly (130) is slidingly coupled to frame extension (120) and vertically displaceable thereon. Vertical displacement of guide arm assembly (130) is made substantially effortless by a counter weight system (140) coupled to guide arm assembly (130) by a flexible member (141). Counter weight system (140) includes a floating pulley system (145) to compensate for changes in cable path length which result from the vertical displacement of guide arm assembly (130). Additionally, guide arm assembly (130) includes a system for increasing the load resistance by varying the mechanical advantage of the cable system. The change in mechanical advantage is accomplished by coupling the releasable coupling (192) at the exit end of cable (132) to the pivotable arm member (172) allowing the cable to be withdrawn from guide arm assembly (130) by displacement of both the exit end of cable (132) and a portion of cable (132) from a position intermediate a first pulley assembly (134) by a second pulley assembly (136), when pivotal arm member (172) is displaced.

19 Claims, 4 Drawing Sheets

MULTI-EXERCISE SYSTEM

BACKGROUND OF THE INVENTION

1. Field of the Invention

This invention directs itself to home gym systems for performing weight lifting exercises. In particular, this invention directs itself to home exercise machines wherein a load resistance is coupled to a cable against which a force is applied. Still further, this invention directs itself to a home gym system having a main frame in which is disposed the load resistance coupled to one end of a cable having an opposing end directed to the user by a plurality of pulley wheels. More in particular, a portion of the pulley cable guidance system is provided by a guide arm assembly vertically displaceable on a frame extension, the frame extension in turn being pivotedly coupled to at least one side of the main frame. Further, this invention directs itself to a vertically displaceable guide arm assembly whose displacement is made substantially effortless by means of a counter weight system coupled to the guide arm assembly by means of a flexible member. Still further, the counter weight system includes a floating pulley system for compensating for changes in cable path length when the guide arm assembly is vertically displaced. Additionally, the guide arm assembly is provided with means for increasing the load resistance by varying the mechanical advantage of the cable system.

2. Prior Art

Home gym systems are well-known in the art. The best prior art known to the Applicant includes U.S. Pat. Nos. 931,699; 723,625; 4,349,192; 2,977,120; 4,549,733; 776,824; 3,614,097; 4,149,714; 4,169,589; 4,346,888; 4,349,191; 4,358,108; 4,546,970; and, 4,566,691.

Some prior art systems, such as shown in U.S. Pat. Nos. 931,699 and 723,625 are directed to exercise systems having a load resistance coupled to one end of a cable and having an opposing end guided to the user by a plurality of pulleys. However, such systems do not provide for an adjustable pulley outlet height and therefore must provide a plurality of separate outlet pulleys, each in contiguous interfacing relationship with a separate cable end and handle assembly. Further, when a pair of such units are used in side-by-side relationship, the pulley systems are fixedly coupled to the building structure and do not provide for adjustability of the lateral distance between the pairs of units.

In other prior art systems, such as U.S. Pat. No. 4,349,192, there is provided a counterbalanced weight system wherein the weight of the lifting hardware is counterbalanced such that the selectable weights are solely that which constitutes the work of the exercise. In such systems, the actuator for displacing the load resistance is of significant weight and therefore counterbalanced to simplify the user's adjustment of the load resistance, and is not provided to aid in the adjustment of the vertical height of the actuation system.

In still other prior art systems, such as U.S. Pat. Nos. 2,977,120 and 4,549,733 there are provided exercise systems having cable guide assemblies which are vertically displaceable on a frame member. In such systems however the cable is kept taut by either manually adjusting the height of the idler pulley to compensate for displacement of the output pulley or a cable pulley system is utilized wherein the cable path length is unaffected by displacement of the output guide assembly. In these prior art systems however, the guide arm assemblies are not counterbalanced, are not adjustable laterally, and no means is provided for increasing the load resistance by varying the mechanical advantage of the cable system, as provided by the instant invention.

SUMMARY OF THE INVENTION

A home gym multi-exercise system for performing weight lifting exercises with a load resistance coupled to a cable is provided. The home gym system includes a vertically extended stationary frame and a plurality of weights selectively coupled to one end of the cable, for defining the load resistance which is disposed within the main frame. Pivotedly coupled to at least one side of the main frame there is provided a movable frame extension to which is slidingly coupled a guide arm assembly. The guide arm assembly is vertically displaceable on the frame extension for directing one end of the cable. Additionally, the home gym system includes a counter weight system coupled to the guide arm assembly for (1) substantially counterbalancing the guide arm assembly, and (2) releasably locking the guide arm assembly in a selected vertical positional location. Coupled to the cable end exiting from the guide arm assembly is an actuator system engageable by a portion of user's body for applying a force thereto.

DESCRIPTION OF THE PREFERRED EMBODIMENTS

Figure 1:
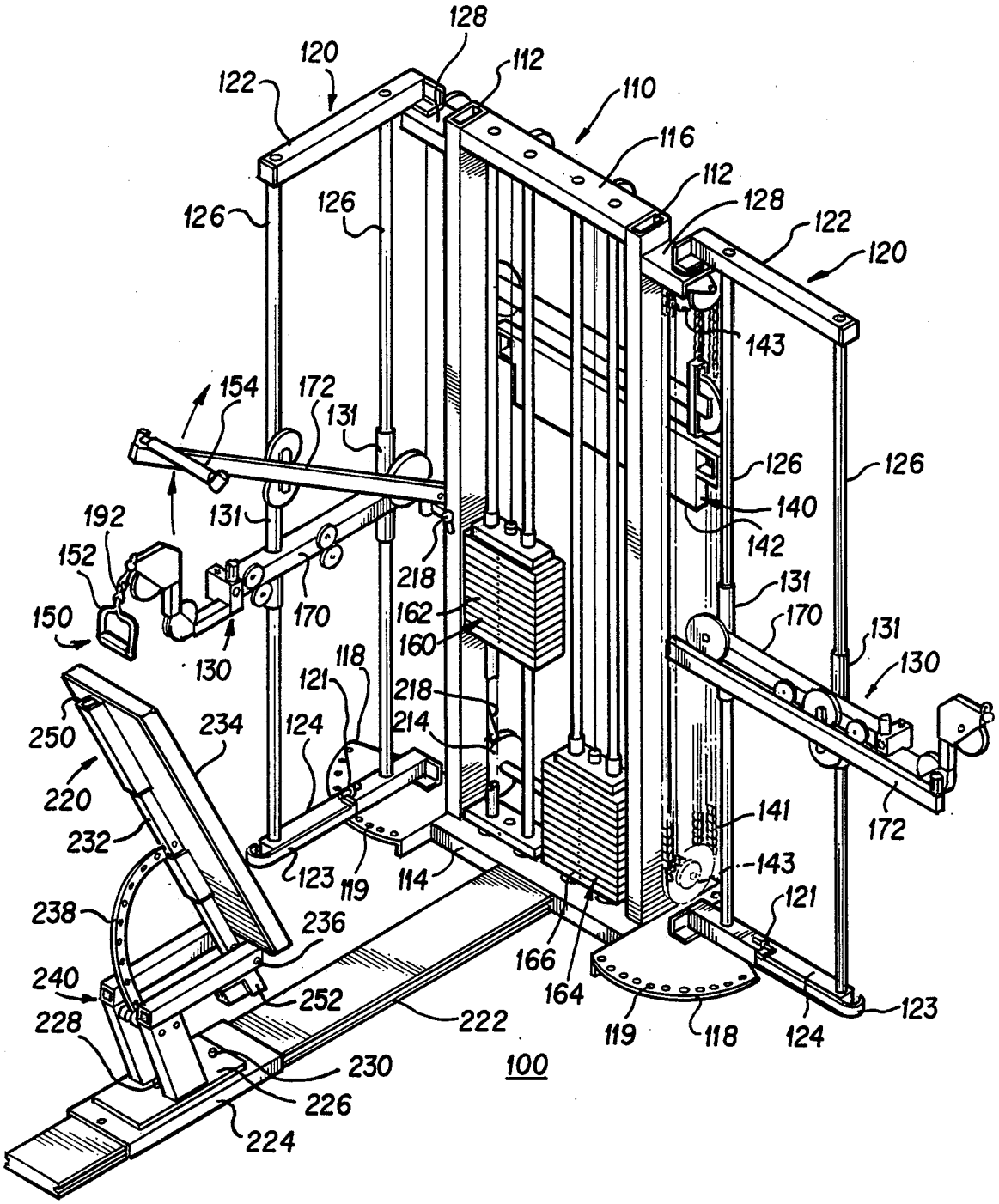
FIG. 1 is a perspective view of the home gym system.

Referring now to FIGS. 1–8, there is shown home gym system 100 for performing weight lifting exercises therewith. As will be seen in following paragraphs, home gym system 100 is specifically directed to the concept of providing a system adaptable to performing a wide variety of exercises. Although not restricted to home utilization, home gym system 100 is particularly adapted for use as a universal gym system having an actuator system 150 adjustably positionable to allow the user to work against the load resistance 160, 164 from a wide variety of orientations. Additionally, home gym system 100 provides a relatively compact system incorporating a novel arrangement of cable and pulleys to provide a means for altering the mechanical advantage of system 100 to increase the load resistance above the total accumulation of weights 162 or 166 which define the respective load resistances 160 or 164.

Main frame 110 is a vertically extended stationary frame structure having a pair of tubular side members 112 defining opposing sides of main frame 110. Each of tubular side members 112 are fixedly coupled to a base member 114 on one end, and fixedly coupled on the opposing end to a top cross member 116. Thus, a rectangular frame-like structure is provided by the main frame 110. As shown in FIG. 1, home gym system 100 includes a movable frame extension 120 pivotedly coupled to tubular side member 112. In the embodiment shown, where system 100 is a bilateral device for simultaneously exercising muscle groups on both left and right sides of the user, system 100 is provided with a pair of frame extensions 120 each pivotedly coupled to opposing sides of main frame 110. However, in a simpler alternate embodiment where one limb would be exercised at a time, system 100 can be constructed with a single frame extension 120. The construction of this simpler system can be understood by one skilled in the art from the disclosure of the bilateral system as herein described, since it is symmetrically constructed relative to main frame 110.

Frame extension 120 is constructed with a top cross member 122 joined to a bottom cross member 124 by a pair of substantially parallel vertical tubular members 126. Top cross member 122 is pivotedly coupled to tubular side member 112 by hinge support 128 fixedly coupled to tubular member 112 and providing a pivotal connection with the top cross member 122 of frame extension 120. Similarly, bottom cross member 124 is pivotedly coupled to the base extension plate 118 which is coupled to, and extends from, base member 114 of main frame 110. Thus providing a structure wherein the movable frame extension 120 can be positioned at a selected angle relative to main frame 110.

Extension frame 120 may be releasably lockingly secured in any one of a plurality of predetermined angular positions, relative to main frame 110. Base extension plate 118 is provided with a plurality of through openings 119 arranged radially about the pivot point for frame extension 120. In alignment with through openings 119, bottom cross member 124 is provided with a through opening formed therein for passage of a pin 121. Pin 121 extends through bottom cross member 124 and into a corresponding one of base extension plate through openings 119 for locking the position of frame extension 120. Frame extension 120 is released from the locked position by depression of the lever 123, which is pivotedly coupled to bottom cross member 124 and is adapted at one end to lift pin 121 when the opposing end is depressed, to free the frame extension 120 from its locked engagement with base extension plate 118 for movement about its pivot.

Each frame extension 120 of home gym system 100 is provided with a guide arm assembly 130 for directing one end of the cable 132 which is coupled to the load resistance 160 or 164 on an opposing end thereof. Guide arm assembly 130 is vertically displaceable on extension frame 120 and releasably lockingly engageable in any of a plurality of discrete vertical positions. Additionally, to make the positioning of guide arm assembly 130 substantially effortless, guide arm assembly 130 is coupled to a counter weight system 140.

Figure 2:
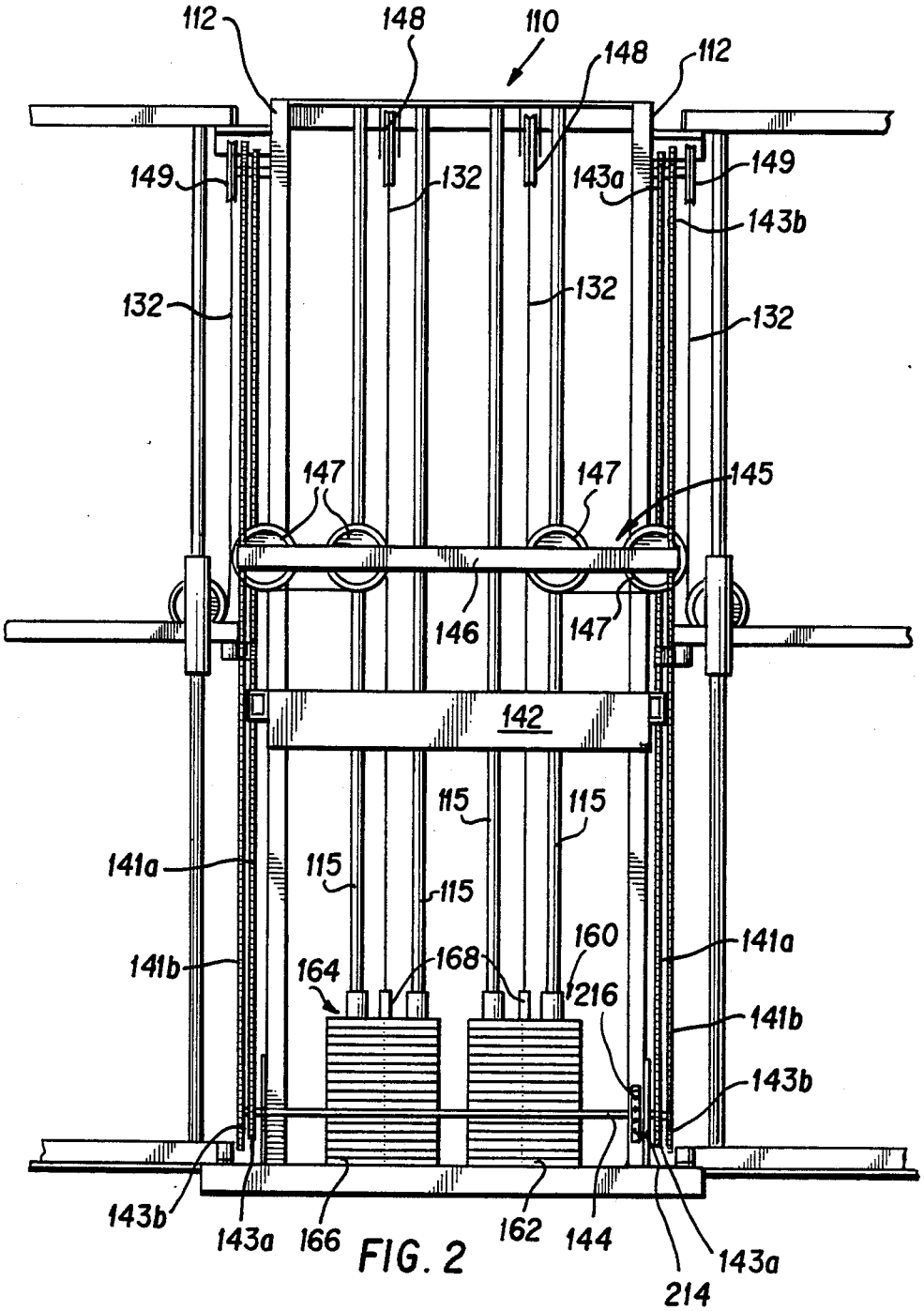
FIG. 2 is a partial rear plane view of the home gym system.

Counter weight system 140, as shown in FIGS. 1 and 2, includes a weighted member 142 having a predetermined weight to balance the weight of guide arm assembly 130. Thus, the displacement of guide arm assembly 130 from one vertical position to another will require very little effort as guide arm assembly 130 will be substantially weightless. Guide arm assembly 130 is coupled to counter weight system 140 by a flexible member 141 adapted to permit guide arm system 130 to be vertically displaced in one direction while counter weight system 140 is equally displaced in an opposing direction.

In one working embodiment, each guide arm assembly 130 is coupled to weighted member 142 by a first chain **141*a* suspended vertically adjacent the respective vertical tubular side member 112 of main frame 110 by a pair of sprockets 143 positioned adjacent opposing vertical ends of main frame 110. First endless chain 141*a* is interfacingly and contiguously mated with the two sprockets 143 to form a continuous loop, with the respective guide arm assembly 130 being fixedly coupled to one side of the loop and weighted member 142 being coupled on the opposing side. Thus, as the guide arm assembly 130 is raised weighted member 142** is lowered to provide the counterbalancing effect.

When guide arm assembly 130 is vertically displaced on frame extension 120 the cable path length between the actuator system 150 and load resistance 160 or 164 changes. Since the cable 132 is of fixed length some means must be provided to compensate for the effective change in path length between the actuator system 150 and the load resistance. To overcome this problem, counter weight system 140 includes a floating pulley system 145 for maintaining the cable 132 in a taut condition throughout the range of vertical displacement for guide arm assembly 130.

The floating pulley system 145 is coupled to a second endless chain **141*b* which is similarly suspended by a pair of vertically displaced sprockets 143*b*. The sprockets 143*b* are coupled to sprockets 143*a* by a common drive shaft 144 to provide synchronous movement of the two chains. In this way, with floating pulley system 145 coupled to chain 143*b* on the same side of the chain as weighted member 142, the floating pulley system 145 moves in synchronism with the weighted member 142, opposite the direction of the guide arm assembly 130. Thus, the floating pulley system 145, by moving in a direction opposite that of guide arm system 130, automatically compensates for the change in cable path length due to movement of the guide arm system 130** by maintaining the cable path length substantially constant.

Floating pulley system 145 includes a frame member 146 which is fixedly coupled to the chain **141*b* to provide the coordinated displacement of the floating pulley system 145 relative to the guide arm assembly 130. For each guide arm assembly 130 included in the home gym system 100 there is provided a pair of pulley wheels 147 pivotedly coupled to frame member 146 for guiding the cable 132 from guide arm system 130 to the respective load resistance 160, 164. Thus, in the illustrated embodiment, having a pair of frame extensions 120, each having a guide arm assembly 130, chains 141*a* and 141*b* are located on both sides of main frame 110 with their respective sprockets 143*a* and 143*b* being coupled by a single drive shaft 144 to provide synchronous movement of the two guide arm assemblies for simultaneous displacement of both assemblies to the same vertical height. Obviously, the weighted member 142 must be of sufficient weight to counterbalance both guide arm assemblies 130 for the bilateral system 100**.

Each of the load resistances 160 and 164 are coupled to a respective cable 132 which in turn is guided through a plurality of direction changing pulleys, floating pulley system 145 and the respective guide arm assembly to the actuator system 150 which is engaged by a portion of the user's body to apply a force against the load resistance. It should be understood that the cable systems for both first load resistance 160 and second load resistance 164 are identical and have identical respective cable paths, such that the description for one should be sufficient to one skilled in the art to understand the structure and operation of a home gym system 100 having two guide arm assemblies 130, each guiding a cable to a respective load resistance 160, 164. The load resistance 160 coupled to one end of cable 132, for example, is defined by a plurality of first weights 162 selectively coupled to cable 132 by means of a pin, not shown, passing through an aperture in a selected weight 162 and a corresponding aperture in the weight coupling tube 168, which passes through a central opening in each of the weights 162. Such selectable weight coupling systems are well known in the art and not important to the inventive concept as herein described. The load resistance 160 is maintained within the main frame 110 by a pair of tubular guide members 115 to which the plurality of weights 162 are slidingly coupled.

The cable 132 extends from the weight coupling tube 168 to a first direction changing pulley 148, pivotedly coupled to top cross member 116, which directs the cable 132 down to the floating pulley wheels 147. The floating pulleys 147 direct the cable out toward the extension frame 120 and up to a second direction changing pulley 149, pivotedly coupled to hinge support 128. The cable 132 passes over second direction changing pulley 149 and passes down to the guide arm assembly 130.

Referring now to FIGS. 1–4, it can be seen that guide arm assembly 130 includes a plurality of pulley wheels for guiding cable 132 to the cable pull handle 152 of actuator system 150. In addition to guiding cable 132 to the cable pull handle 152, the novel arrangement of pulleys provides a means for increasing the load resistance by varying the mechanical advantage of the cable system. This is accomplished with two pulley assemblies, a first pulley assembly 134 pivotedly coupled to a fixed arm member 170 and a second pulley assembly 136 pivotedly coupled to a pivotable arm member 172.

The first pulley assembly 134 includes a direction changing pulley wheel 180 for receiving the cable 132 from second direction changing pulley 149 and directing it in a direction substantially parallel with the fixed arm member 170 of guide arm assembly 130. Cable 132 is captured between a first pair of first pulley wheels 182 positioned in vertically opposing relationship and between a second pair of first pulley wheels 184, similarly arranged in vertically opposing relationship. Intermediate the first pair of first pulley wheels 182 and the second pair of first pulley wheels 184 a second pulley assembly 136, pivotedly coupled to pivotable arm member 172 is positionally located to be coplanar with both the first and second pairs of first pulley wheels 182 and 184. Second pulley assembly 136 includes a pair of vertically opposing second pulley wheels 186 pivotedly coupled to a pulley frame member 188. Pulley frame member 188 is fixedly coupled to pivotable arm member 172 to allow displacement of the load resistance 160 by the pivotal movement of pivotable arm member 172 relative to the fixed member 170.

Pivotable arm member 172 is pivotedly coupled to fixed arm member 170 at a first end **172*a* and is normally maintained in a substantially parallel relationship with fixed member 170 by the tension of cable 132 captured between the pulley wheels 186 of second pulley assembly 136. This arrangement allows exercises to be performed by pulling the cable pull handle 152 or in the alternative, pivotedly displacing the pivotable arm member 172 relative to the fixed arm 170 with the removable handle 154 for vertically displacing the load resistance 160**.

Guide arm assembly 130 further includes a wrist assembly 174 rotatably coupled to stationary arm member 170 for positioning the end of cable 132 and the cable pull handle attached thereto in a selected one of a plurality of discrete positions. Wrist assembly 174 includes a horizontal arm member 176 having a substantially square cross-sectional contour, which is releasably positionally clamped to stationary arm member 170 by clamping arrangement 200, to be described in following paragraphs.

For the embodiment shown, horizontal arm member 176 can be oriented in any one of four directions. Alternately, if more than four discrete orientations for wrist assembly 174 is desired, then horizontal arm member 176 can be formed from a tubular member having a polygonal cross-sectional configuration to provide the desired number of discrete positions for orienting the assembly.

Wrist assembly 174 further includes a vertical arm member 178 fixedly coupled to horizontal arm member 176 and an intermediate pulley wheel 175 located adjacent the junction of the horizontal and vertical arm members for changing the direction of cable 132 from horizontal to vertical. The opposing end of vertical arm member 178 is provided with an output pulley wheel 177 for directing the cable as it is withdrawn from the guide arm assembly 130.

The cable end positionally located at output pulley wheel 177 is provided with a cable stop 190 for preventing the end of the cable 132 from being drawn into the guide arm assembly 130 when pivotable arm 172 is displaced relative to fixed arm 170. Cable stop 190 is drawn against the wrist hood member 179, coupled to vertical arm member 178 and at least partially encompassing output pulley wheel 177, thereby preventing the cable end from being drawn into the guide arm assembly when pivotable arm member 172 is utilized for vertically displacing the load resistance 160. The end of cable 132 is also provided with a releasable coupling 192 for coupling to cable pull handle 152 or other accessory devices.

Of particular importance to the inventive concept, is the method and structure which permits increasing the load resistance by varying the mechanical advantage of the cable system. For example, by orienting the wrist assembly 174 in the direction shown in FIG. 5, removing the cable pull handle 152 from the releasable coupling 192 and then connecting releasable coupling 192 to the lower coupling loop **194*b* of pivotable arm member 172, increases the effective load resistance without adding additional weights 162 to the load 160**.

Thus, when the pivotable arm 172 is displaced in the direction indicated by direction arrow 196, the cable is pulled by both the lower cable loop **194*b* and the second pulley assembly 136, which results in a greater displacement of the load resistance 160 per unit of displacement of pivotable arm member 172. Therefore, the mechanical advantage of the cable system is changed from a ratio of 1:1 to a factor of less than one. The change in mechanical advantage is determined by the distance from the pivotal coupling at first end 172*a* of pivotable arm member 172 to the second pulley assembly 136 and the distance to the coupling loops 194*a* and 194*b*. In one working embodiment, second pulley assembly 136 and coupling loops 194***a* and 194*b* have been located on pivotable arm member 172 to provide a change in mechanical advantage from 1:1 to 1:2, effectively doubling the load resistance provided by the weights 162.

Figure 5:
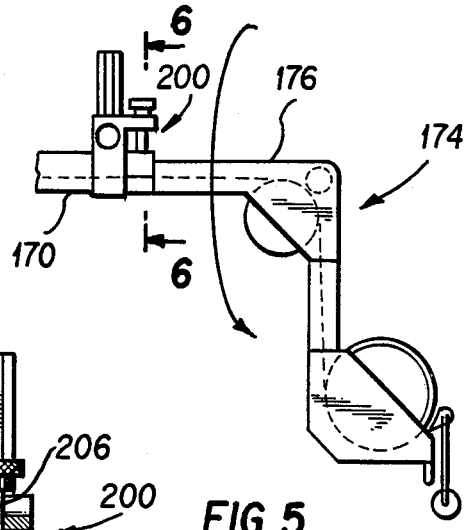
FIG. 5 is a cutaway plane view of the wrist assembly for the home gym system.
Figure 6:
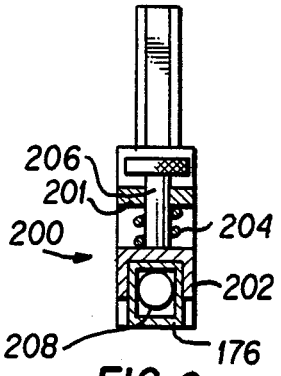
FIG. 6 is a sectional view of the wrist assembly coupling taken along the section line 6—6 of FIG. 5.
Figure 7:
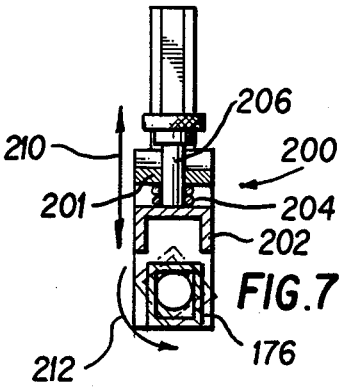
FIG. 7 is a sectional view of the wrist assembly coupling taken along the section line 6—6 of FIG. 5 showing the coupling disengaged to permit rotation of the wrist assembly; and, FIG. 8 is a sectional plane view showing an actuator system attachment coupled to the guide arm assembly.

Referring now to FIGS. 5–7, there is shown wrist assembly 174 and clamp 200 for locking wrist assembly 174 in any one of four discrete orientations relative to fixed arm member 170 of guide arm assembly 130. Horizontal arm member 176 is pivotedly joined to fixed arm member 170 by hollow tubular shaft 208, providing a pivot about which horizontal arm member 176 may be rotated. Hollow tubular shaft 208 also acts as a conduit for passage of cable 132 from fixed arm member 170 to horizontal arm member 176.

Clamp 200 releasably engages horizontal arm member 176 with a saddle member 202 which engages at least a portion of each of two opposing sides of the horizontal arm member 176 to prevent rotation about the pivot provided by tubular shaft 208. Saddle member 202 is coupled to a pin member 206 for providing a means to operably engage and disengage saddle 202 from the horizontal arm member 176. Pin member 206 is guided by a pin support 201 having a through opening through which the pin 206 is slidingly coupled. Saddle 202 is biased into engagement with horizontal arm member 176 by spring 204 which encompasses pin 206 and is positioned between pin support 201 and saddle 202.

As shown in FIG. 7, clamp 200 is disengaged by lifting pin 206 in the direction indicated by directional arrow 210. This action disengages saddle 202 from horizontal arm member 176 allowing it to be rotated as indicated by the directional arrow 212. For the embodiment shown, wrist assembly 174 may be rotated and releasably lockingly engaged in discrete increments of 90°, which appears to be satisfactory for performing all of the known weight lifting exercises currently used.

Figure 8:
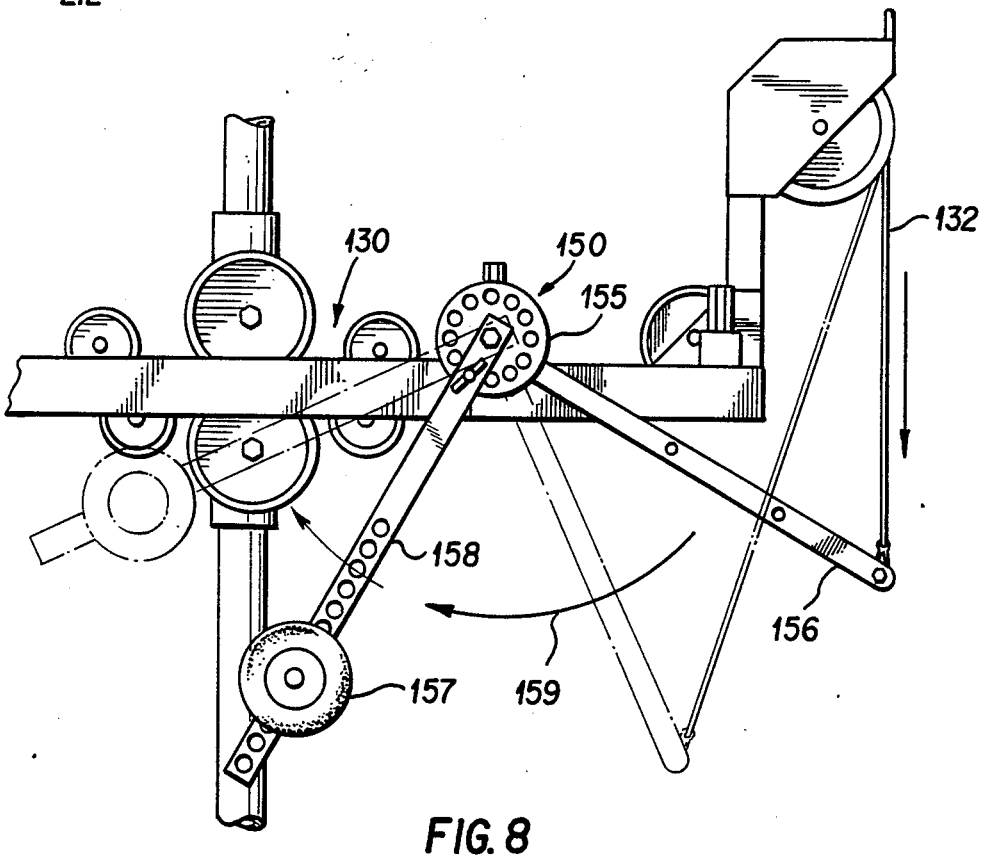

Referring now to FIG. 8, there is shown cable lever assembly 155 of actuator system 150 coupled to cable 132 for providing an alternate means to apply a force against the load resistance 160. Cable lever assembly 155 includes a cable arm member 156 pivotedly coupled to fixed arm member 170 of guide arm assembly 130 at one end, and coupled to cable 132 on the opposing end. Cable lever assembly 155 also includes an adjustable operator arm 158, releasably coupled in adjustable angular relationship with cable arm member 156 to form a bell crank like assembly. Coupled to operator arm 158 is a handle member 157 which may be coupled to operator arm 158 in any one of a plurality of discrete locations for applying a force with the user's hands, arms, legs or feet.

Referring back to FIGS. 1 and 2, home gym system 100 is provided with a main frame 110 wherein there is disposed a first load resistance 160 defined by a plurality of first weights 162 and a second load resistance 164 defined by a plurality of second weights 166, each of load resistances 160 and 164 are coupled to a respective cable 132 on one end, and an actuator system 150 on the opposing end. Pivotedly coupled to opposing sides of main frame 110 are frame extensions 120, each having a guide arm assembly slidingly coupled thereon. Guide arm assembly 130 is coupled to frame extension 120 by a pair of guide sleeves 131 having a tubular contour fixedly coupled to fixed arm member 170 of guide arm assembly 130. Each of sleeve members 131 is slidingly engaged with a respective vertical tubular member 126 of frame extension 120 for allowing vertical displacement of guide arm assembly 130 on frame extension 120.

The vertical displacement of guide arm assembly 130 is made effortless by means of counter weight system 140. The fixed arm member 170 of each of guide arm assembly 130 is coupled to one side of a respective chain 141*a* formed in a continuous loop about a pair of vertically displaced sprockets 143*a*. A weighted member 142 is coupled to the opposing side of chain 141*a* to counterbalance the weight of guide arm assembly 130. With guide arm assembly 130 being coupled on one side of the looped chain 141*a* and the weighted member 142 being coupled to the opposing side, weighted member 142 is vertically displaced in an opposing direction to the displacement of guide arm assemblies 130 to provide the counter weight action.

Counter weight system 140 also includes a floating pulley system 145 for maintaining cable 132 in a taut condition regardless of the position of guide arm assemblies 130. Although floating pulley system 145 could be coupled directly to weighted member 142 to provide the function of taking up and letting out cable 132 as guide arm assemblies 130 are repositioned on frame extensions 120, the embodiment shown provides a second chain 141*b* formed in a continuous loop about a second pair of vertically displaced sprockets 143*b*. Sprockets 143*b* and 143*a* are coupled to a common drive shaft 144 to provide synchronous displacement of floating pulley system 145 and both guide arm assemblies 130, located on opposing sides of main frame 110. Coupling pulley system 145 indirectly to weighted member 142 by means of a separate chain and sprocket assembly allows the sprocket gear ratios to be predetermined for minimizing the size of weighted member 142 and providing a preselected distance between pulley wheels 147 of floating pulley member 145.

Counter weight system 140 also includes the means to releasably lock guide arm assemblies 130 in the selected position. Locking wheel 214 is coupled to drive shaft 144, and is provided with a plurality of radially arranged hollow bores formed about its perimeter. In this way, rotation of drive shaft 144 is prevented by engaging one of hollow bores 216 with a pin 218 which is slidingly coupled to tubular side member 112. Thus, by disengaging pin member 218 from lock wheel 214 guide arm assemblies 130 may be vertically displaced to a desired vertical position. To maintain guide arm assemblies 130 at this selected position, pin member 218 is reengaged with lock wheel 214 by insertion of the end of the pin member into a respective one of hollow bores 216.

Figure 3:
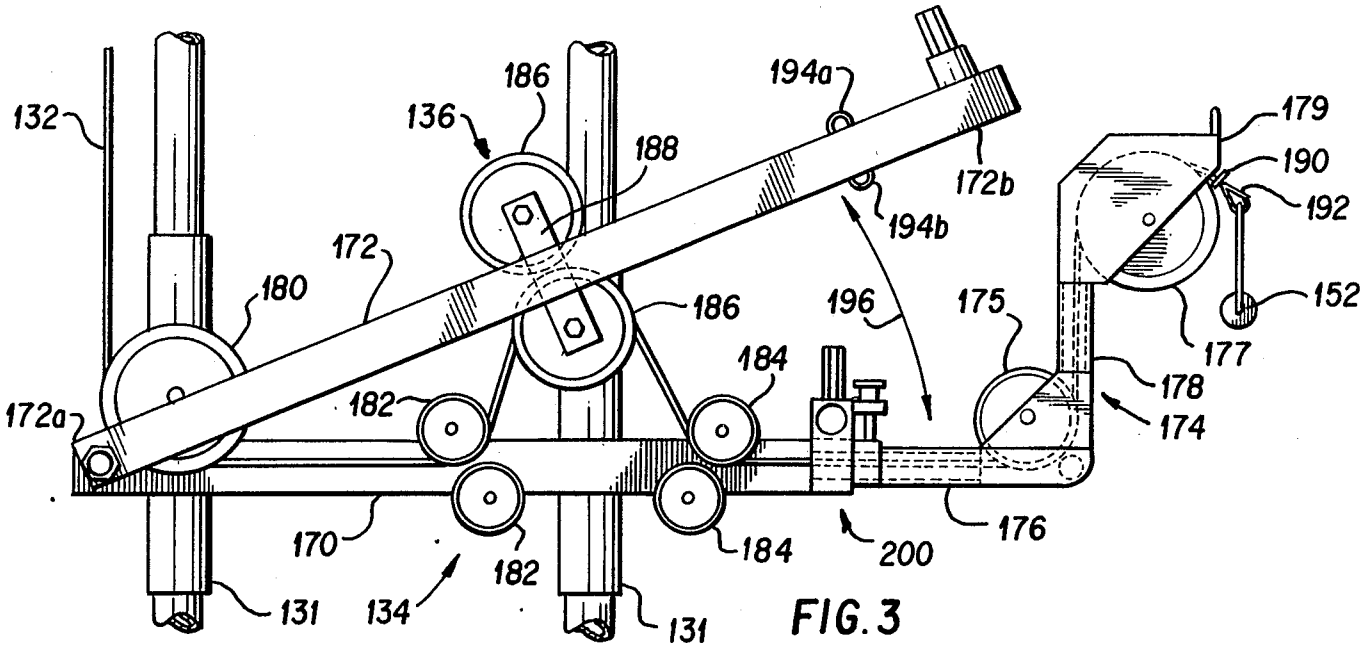
FIG. 3 is a cutaway plane view of the guide arm assembly of the home gym system.
Figure 4:
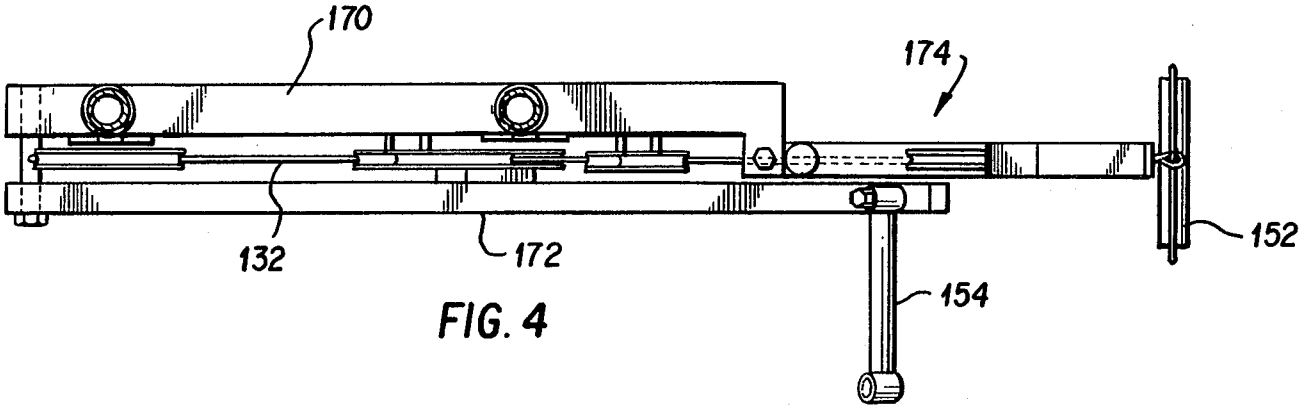
FIG. 4 is a top plane view of the guide arm assembly of the home gym system.

Subsequent to positioning of guide arm assemblies 130, exercises may be performed using any of the actuator system 150 accessories, such as the cable pull handle 152 which is releasably coupled to the end of cable 132 by releasable coupling 192. Alternately, the bar handle 154 which can be releasably coupled to pivotable arm member 172 can be utilized. As shown in FIG. 3, when pivotable arm member 172 is displaced relative to fixed arm member 170 cable 132 is pulled by one of pulley wheels 186 of second pulley assembly 136, depending upon the direction pivotable arm member 172 is rotated relative to fixed arm member 170, up or down.

When pivotable arm member 172 is utilized for bench press type exercises, load resistances above the capacity of first weights 162 and second weights 166 may be required, as this type of exercise typically requires a greater load resistance than the majority of other exercises performed on home gym system 100. To provide for this requirement, guide arm assemblies 130 are provided with means for increasing the load resistance by varying the mechanical advantage of the cable system. With wrist assembly appropriately oriented, releasable coupling 192 is coupled to one of either upper coupling loop 194*a* or lower coupling loop 194*b*, depending upon the direction pivotable arm member 172 is to be displaced. Thus, as pivotable arm member 172 is displaced, cable 132 is withdrawn from system 100 by both the coupling loop 194 coupled to the end of cable 132 and by the pulley wheel 186, creating a reduced mechanical advantage and thereby increasing the load resistance.

As shown in FIG. 1, home gym system 100 is provided with an adjustable bench assembly 220 coupled to main frame 110. Adjustable bench assembly 220 includes a track 222 fixedly coupled to base member 114 of main frame 110 and extends substantially orthogonal therefrom. A slide base 224 is slidingly coupled to track 222 to allow positioning of the bench assembly 220 relative to main frame 110.

The bench base assembly 240 includes a pivot plate 226 which is pivotedly coupled to slide base 224 by a pivot 228 for allowing rotation of adjustable bench assembly 220 relative to main frame 110. Corresponding apertures are provided in both pivot plate 226 and slide base 224 to permit a locking pin 230 to releasably lock the position in either of two orientations. Thus, bench assembly 220 can be lockingly positioned in a first orientation or rotated 180° to be lockingly held in a second orientation.

To further add to the adjustability of bench assembly 220, the bench top 234 is slidingly coupled to the bench support frame 232 and may be locked in place by means of a pin, not shown. Further, the bench support frame 232 is pivotedly coupled to base assembly 240 by means of the bench elevation pivot 236. This arrangement allows the bench support frame 232 and bench top 234 to be elevated in any one of a plurality of discrete angular positions relative to main frame 110. The discrete positions to which the bench support frame 232 and bench top 234 can be raised is established by guide bar 238, having a plurality of through openings spaced to provide, in one working embodiment, 10° of angular displacement of bench support frame 232 and bench top 234. The angular position selected for bench top 234 is maintained by a pin, not shown, which passes through a corresponding aperture in base assembly 240 and one of the plurality of apertures formed in guide bar 238. Further, versatility is achieved for adjustable bench assembly 220 by providing accessory couplings 250 and 252 at opposing ends of bench support frame 232 into which is inserted a variety of support elements for aiding in the performance of a wide variety of exercises.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A multi-exercise system for performing weight lifting exercises with a load resistance coupled to a cable, comprising:

a. a vertically extended stationary main frame;

b. a plurality of weights selectively coupled to one end of said cable for defining said load resistance disposed within said main frame;

c. at least one movable frame extension, said frame extension being pivotedly coupled to said main frame on one side thereof;

d. guide arm means vertically displaceable on said frame extension for directing an opposite end of said cable, said guide arm means includes (1) a first arm member slidingly coupled to said frame extension and extending longitudinally therefrom, and (2) first pulley means coupled to said first arm member for guiding said cable substantially parallel to said first arm member said first pulley means including at least a first and second pair of vertically opposing first pulley wheel members disposed on said first arm member for capturing said cable therebetween, (3) a second arm member pivotedly coupled at one end to a first end of said first arm member, and (4) second pulley means fixedly coupled to said second arm member for coupling said cable to said second arm member relative to said first arm member transmits an applied force to said load resistance;

e. counter weight means coupled to said guide arm means for (1) substantially counterbalancing said guide arm means, and (2) releasably locking said guide arm means in a selected vertical positional location; and f. actuator means coupled to said opposing end of said cable and engageable by a portion of a user's body for applying a force thereto.

2. The multi-exercise system as recited in claim 1 wherein said counter weight means includes (1) a counterbalancing weight coupled to said guide arm means by a flexible member, and (2) floating pulley means coupled to said counterbalancing weight and said cable for maintaining said cable in a taut condition responsive to vertical displacement of said guide arm means.

3. The multi-exercise system as recited in claim 1 wherein said frame extension being releasably lockable in a selected one of a plurality of discrete angular positions relative to said side of said main frame.

4. The multi-exercise system as recited in claim 1 wherein said system includes a pair of movable frame extensions, each of said pair of frame extensions being pivotedly coupled to opposing sides of said main frame and each having said guide arm means vertically displaceable thereon.

5. The multi-exercise system as recited in claim 1 wherein said system includes bench means releasably coupled to said main frame and displaceable therefrom for supporting at least a portion of said user's body, said bench means including a body support member and positioning means coupled to said body support member for (1) releasably locking said body support member at a selected displacement from said main frame, (2) releasably locking said body support member at a selected one of a plurality of discrete vertically angular positions relative to said main frame, and (3) releasably locking said body support member at a selected one of a plurality of discrete horizontally angular positions relative to said main frame.

6. The multi-exercise system as recited in claim 1 wherein said second pulley means includes a pair of vertically opposed second pulley wheel members for capturing said cable therebetween, said pair of second pulley wheel members being disposed intermediate said first and second pairs of first pulley wheel members and substantially coplanar therewith.

7. The multi-exercise system as recited in claim 6 wherein said actuator means includes a handle arm member releasably coupled to said second arm member.

8. The multi-exercise system as recited in claim 6 wherein said guide arm means further includes wrist means rotatably coupled to said first arm member for positioning said opposing cable end in a selected one of a plurality of discrete positions.

9. The multi-exercise system as recited in claim 8 wherein said guide arm means further includes means for increasing said load resistance releasably coupled to said second arm member and said opposing cable end.

10. The multi-exercise system as recited in claim 8 wherein said wrist means includes (1) a horizontal arm member having a first end rotatably coupled to said first arm member, (2) a vertical arm member having an end fixedly coupled to a second end of said horizontal arm member, (3) an intermediate pulley wheel member positionally located adjacent a junction of said horizontal and vertical arm members for directing said cable from said horizontal arm to said vertical arm, and (4) an output pulley wheel member coupled to an opposing end of said vertical arm member.

11. The multi-exercise system as recited in claim 10 wherein said actuator means includes a handle member releasably coupled to said opposing cable end for displacing said cable in contiguous interfacing relationship with said output pulley wheel.

12. The multi-exercise system as recited in claim 11 wherein said actuator means includes lever means pivotedly coupled to said first arm member and releasably coupled to said cable for displacing said cable in contiguous interfacing relationship with said output pulley wheel.

13. A multi-exercise system for performing weight lifting exercises with a pair of load resistances each coupled to one of a pair of cables, comprising:

a. a vertically extended stationary main frame defined by a pair of opposing side members;

b. a plurality of first weight members disposed within said main frame and selectively coupled to one end of one of said pair of cables for defining at least a portion of said load resistance;

c. a plurality of second weight members disposed within said main frame and selectively coupled to one end of the other of said cables for defining at least a portion of said load resistance;

d. a pair of movable frame extensions, each of said pair of frame extensions being pivotedly coupled to one of said opposing side members;

e. guide arm means vertically displaceable on each of said frame extensions for directing a respective opposing end of each of said cables, said guide arm means includes (1) a first arm member slidingly coupled to said frame extension and extending longitudinally therefrom, (2) first pulley means coupled to said first arm member for guiding said cable substantially parallel to said first arm member, said first pulley means including at least a first and second pair of vertically opposing first pulley wheel members disposed on said first arm member for capturing said cable therebetween, (3) a second arm member pivotedly coupled at one end to a first end of said first arm member, and (4) second pulley means fixedly coupled to said second arm member for coupling said cable to said second arm member, whereby displacement of said second arm member relative to said first arm member transmits an applied force to said load resistance; and, f. actuator means coupled to said opposing ends of said pair of cables and engageable by a portion of a user's body for applying a force thereto.

14. The multi-exerciser system as recited in claim 13 wherein said system further includes counter weight means coupled to said guide arm means for (1) substantially counterbalancing said guide arm means, and (2) releasably locking said guide arm means in a selected vertical positional location.

15. The multi-exercise home gym system as recited in claim 14 wherein said counter weight means includes (1) a counterbalancing weight coupled to said guide arm means by a flexible member, and (2) floating pulley means coupled to said counterbalancing weight and said cable for maintaining said cable in a taut condition responsive to vertical displacement of said guide arm means.

16. The multi-exercise system as recited in claim 13 wherein said guide arm means further includes means for increasing said load resistance releasably coupled to said second arm member and said opposing cable end.

17. The multi-exercise system as recited in claim 16 wherein said second pulley means includes a pair of vertically opposed second pulley wheel members for capturing said cable therebetween, said pair of second pulley wheel members being disposed intermediate said first and second pairs of first pulley wheel members and substantially coplanar therewith.

18. The multi-exercise system as recited in claim 17 wherein said guide arm means further includes wrist means rotatably coupled to said first arm member for positioning said opposing cable end in a selected one of a plurality of discrete positions.

19. A multi-exercise system having a predetermined mechanical advantage for performing weight lifting exercises with an adjustable load resistance coupled to a cable, comprising:

a. a vertically extended stationary main frame;

b. a plurality of weights selectively coupled to one end of said cable disposed within said main frame for defining said load resistance;

c. at least one movable frame extension, said frame extension being pivotedly coupled to said main frame on one side thereof;

d. guide arm means vertically displaceable on said frame extension for directing an opposing end of said cable, said guide arm means includes a first arm member slidingly coupled to said frame extension and extending longitudinally therefrom, and a second arm member pivotedly coupled at one end to an end of said first arm member;

e. means for increasing said load resistance coupled to both said guide arm means and said opposing end of said cable, said means for increasing said load resistance includes first pulley means coupled to said first arm member for guiding said cable substantially parallel to said first arm member, and second pulley means fixedly coupled to said second arm member for coupling said cable to said second arm member, whereby said load resistance is increased by displacing said second arm member relative to said first arm member for varying the mechanical advantage of said system; and, f. actuator means coupled to said opposing end of said cable and engageable by a portion of a user's body for applying a force thereto.

* * * * *